US007048604B2

(12) United States Patent
Cusolito et al.

(10) Patent No.: US 7,048,604 B2
(45) Date of Patent: May 23, 2006

(54) LEVITATING BALL TOY

(75) Inventors: Alan Cusolito, Aliso Viejo, CA (US); Kevin W. Gray, Thousand Oaks, CA (US)

(73) Assignee: Mattel, Inc., El Segundo, CA (US)

( * ) Notice: Subject to any disclaimer, the term of this patent is extended or adjusted under 35 U.S.C. 154(b) by 0 days.

(21) Appl. No.: 10/350,565

(22) Filed: Jan. 24, 2003

(65) Prior Publication Data

US 2003/0171064 A1 Sep. 11, 2003

Related U.S. Application Data

(60) Provisional application No. 60/352,332, filed on Jan. 24, 2002.

(51) Int. Cl.
*A63F 9/06* (2006.01)

(52) U.S. Cl. ..... 446/179; 273/441

(58) Field of Classification Search ..... 446/178, 446/179, 176; 273/138.5, 108.57, 119 B, 273/129 AP, 444, 441, 445, 457, 459, 460, 273/359, 368, 398

See application file for complete search history.

(56) References Cited

U.S. PATENT DOCUMENTS

| | | | | |
|---|---|---|---|---|
| 943,472 | A * | 12/1909 | Schreiber et al. | 273/119 B |
| 1,827,885 | A * | 10/1931 | Emenhiser | 273/317.3 |
| 1,850,715 | A * | 3/1932 | Gottfried | 273/405 |
| 2,074,363 | A | 3/1937 | Burke | |
| 2,118,609 | A | 5/1938 | Klug | |
| 2,542,100 | A | 2/1951 | Sturm, Jr. | |
| 2,611,994 | A | 9/1952 | Dailey | |
| 2,912,789 | A | 11/1959 | Clifton | |
| 2,935,176 | A | 5/1960 | Lorenzen | |
| 3,082,570 | A | 3/1963 | Pearson, Jr. | |
| 3,083,497 | A | 4/1963 | Novak et al. | |
| 3,103,362 | A * | 9/1963 | Elofson | 273/359 |
| 3,115,343 | A * | 12/1963 | Lemelson | 273/343 |
| 3,465,471 | A | 9/1969 | Friedman | |
| 3,814,430 | A | 6/1974 | Leumi | |
| 3,887,182 | A | 6/1975 | Breslow | |
| 3,948,521 | A | 4/1976 | Warren | |
| 4,014,543 | A * | 3/1977 | Arad | 273/108.53 |
| 4,045,906 | A | 9/1977 | Goldfarb et al. | |
| 4,079,937 | A * | 3/1978 | Kirsch | 273/359 |
| 4,211,412 | A | 7/1980 | Barlow et al. | |
| 4,268,029 | A * | 5/1981 | Collins | 273/359 |
| 4,292,755 | A | 10/1981 | Houn | |
| 4,347,682 | A | 9/1982 | Hackell | |
| 4,411,095 | A | 10/1983 | Rushing et al. | |
| 4,527,351 | A | 7/1985 | Gerakiteys | |
| 4,598,910 | A * | 7/1986 | Halliburton | 273/119 A |

(Continued)

FOREIGN PATENT DOCUMENTS

EP 271421 A1 * 6/1988

(Continued)

*Primary Examiner*—John A. Ricci
(74) *Attorney, Agent, or Firm*—Kolisch Hartwell, P.C.

(57) ABSTRACT

In one embodiment, the present invention provides a toy wherein a player manipulates a levitated object through an obstacle course. Furthermore, the present invention allows the player to design and build the obstacle course. The toy may include a playing field having a plurality of mounting stations distributed along a pathway and a plurality of obstacles adapted to interchangeably engage the mounting stations. A levitation mechanism may be adapted to produce an air stream and move the air stream along the pathway. In addition, the toy may further include a controller adapted to control movement of the air stream along the pathway.

18 Claims, 6 Drawing Sheets

U.S. PATENT DOCUMENTS

| | | | | |
|---|---|---|---|---|
| 4,634,395 | A | | 1/1987 | Burchett |
| 4,830,374 | A | * | 5/1989 | Follo ..... 273/317.7 |
| 5,186,675 | A | | 2/1993 | D. Stoddard |
| 5,211,596 | A | | 5/1993 | Bradshaw |
| 5,288,071 | A | | 2/1994 | Solomon |
| 5,314,368 | A | | 5/1994 | Cheng |
| 5,383,806 | A | | 1/1995 | Prater |
| 5,772,535 | A | | 6/1998 | Murphy |
| 5,865,690 | A | | 2/1999 | Giannoutsos |
| 6,045,341 | A | | 4/2000 | Mak |

FOREIGN PATENT DOCUMENTS

| | | | | |
|---|---|---|---|---|
| FR | 2782931 | A1 | * | 3/2000 |
| GB | 2053008 | A | * | 2/1981 |
| GB | 2185899 | A | * | 8/1987 |

* cited by examiner

LEVITATING BALL TOY

CROSS REFERENCE TO RELATED APPLICATIONS

The present application claims priority from U.S. Provisional Patent Application Ser. No. 60/352,332, filed Jan. 24, 2002, which is hereby incorporated by reference in its entirety for all purposes.

FIELD OF THE INVENTION

The present invention relates to toys involving games of skill. An aspect of the present invention more particularly relates to toys involving games of skill wherein the goal is to manipulate an object through an obstacle course. Furthermore, the present invention relates to toys in which an object appears to defy gravity by levitating.

BACKGROUND OF THE INVENTION

Games of skill have been popular with both children and adults. Many games of skill involve the manipulation of one or more objects through an obstacle course. Furthermore, children are often entranced by objects that appear to defy gravity by levitating. Examples of various toys wherein an object is manipulated through an obstacle or obstacle course and/or an object is levitated may be found in U.S. Pat. Nos. 2,074,363, 2,118,609, 2,542,100, 2,611,994, 2,850,283, 2,912,789, 2,935,176, 3,082,570, 3,083,497, 3,465,471, 3,814,430, 3,887,182, 3,948,521, 4,045,906, 4,079,937, 4,211,412, 4,292,755, 4,347,682, 4,411,095, 4,496,329, 4,527,351, 4,634,395, 5,186,675, 5,211,596, 5,288,071, 5,314,368, 5,383,806, 5,772,535, 5,865,690, and 6,045,341, the disclosures of which are hereby incorporated by reference in their entirety for all purposes.

SUMMARY OF THE INVENTION

In one embodiment, the present invention provides a toy wherein a player manipulates a levitated object through an obstacle course. Furthermore, the present invention allows the player to design and build the obstacle course. The toy may include a playing field having a plurality of mounting stations distributed along a pathway and a plurality of obstacles adapted to interchangeably engage the mounting stations. A levitation mechanism may be adapted to produce an air stream and move the air stream along the pathway. In addition, the toy may further include a controller adapted to control movement of the air stream along the pathway. The advantages of the present invention will be understood more readily after a consideration of the drawings and the Detailed Description.

DETAILED DESCRIPTION AND BEST MODE OF THE INVENTION

The present invention is a toy for one or more players. The toy is designed such that the players manipulate a levitating object through an obstacle course.

Figure 1:
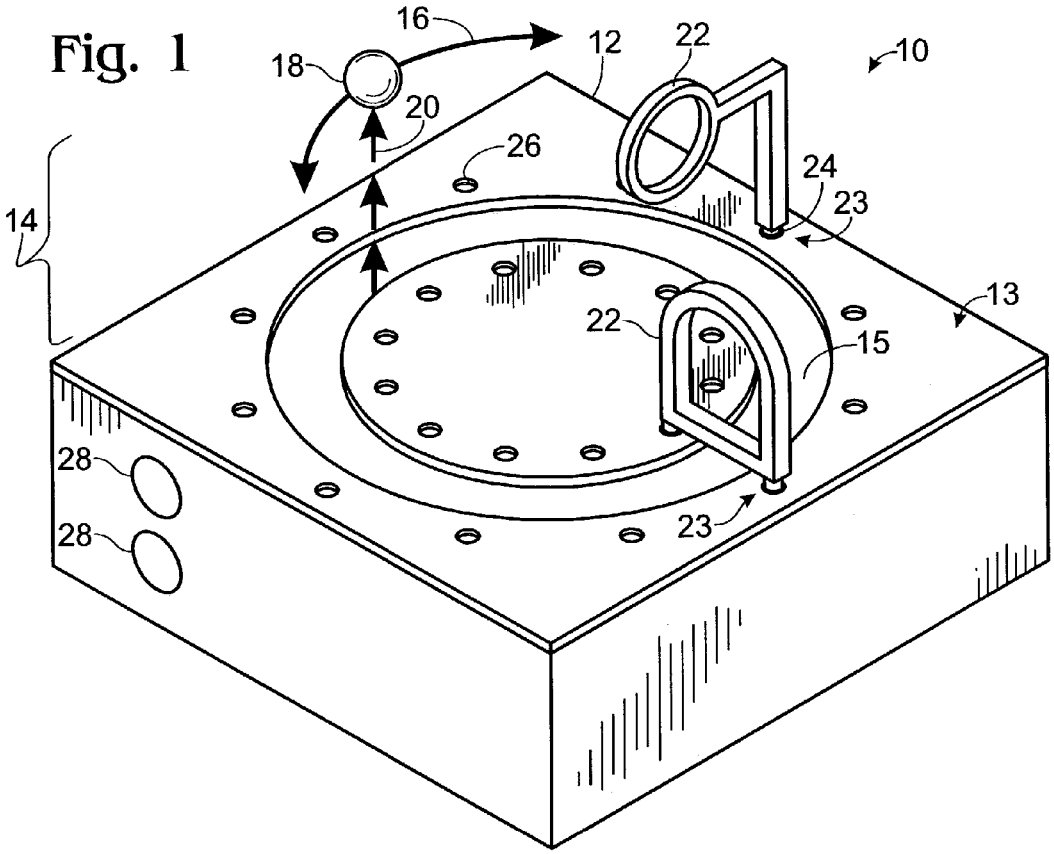
FIG. 1 is an isometric view of a toy according to one embodiment the present invention.

Referring initially to FIG. 1, one embodiment of a toy according to the present invention is generally indicated at 10. Toy 10 includes a body 12. Body 12 has an upwardly facing surface 13 that encompasses a playing field 14. Playing field 14 may be a three dimensional area, surface, or structure along which a manipulable object 18 may be maneuvered. In this embodiment, playing field 14 includes a channel 15, which defines a pathway 16. An air stream 20 originates within body 12 and is directed through channel 15 upwardly from and preferably perpendicularly to pathway 16, such that object 18 is supported by air stream 20 and appears to be levitating above channel 15.

Toy 10 additionally includes a plurality of obstacles 22. Obstacles 22 are structures that alter or obstruct pathway 16 or interfere with the trajectory of object 18 along pathway 16. Obstacles 22 may take any number of suitable shapes and sizes. For example, the obstacles may form a barrier of limited height or define a structured passage, such as hoops, barrels, tunnels, and the like, through or around which object 18 may be manipulated. Alternatively or additionally, some or all of the obstacles may be capable of movement, increasing the challenge and degree difficulty in successfully negotiating the obstacle course.

Obstacles 22 may be selectively and interchangeably positioned along pathway 16 so as to create an obstacle course through which object 18 may be manipulated. The obstacles may be selectively placed along pathway 16 as desired by the user. Typically, a number of obstacles will have the same or a similar mechanism for placement on body 12 such that the obstacles can be easily interchanged. This may be accomplished by distributing a plurality of standard mounting stations 23 along pathway 16. A number of obstacles may have a conforming standard mounting structure that may then be selectively placed in one of the standard mounting stations. For example, a number of obstacles may include one or more securing pins 24, which are securely received by holes 55 on body 12. This pin and hole arrangement allows for the obstacles to be selectively and interchangeable placed along pathway 16 so that the user can create a variety of different obstacle courses. Alternatively and/or additionally, the standard mounting stations may include one or more engagement regions which allow the obstacles to access mechanisms within body 12 in order to translate movement to the obstacles. Exemplary engagement regions and associated obstacles are described in more detail below with reference to FIGS. 5 and 6. As will be appreciated, other methods and mechanisms for temporarily placing interchangeable obstacles along pathway 16 may be used.

Toy 10 may further include one or more control elements 28, which allow the user to manipulate object 18, such as by altering both the force and/or direction of travel of air stream 20 along pathway 16. By altering the force of air stream 20, the user may alter the height at which object 18 floats or levitates above body 12. Moreover, by altering the direction of travel of air stream 20, the user may move object 18 along the pathway. Thus, by coordinately altering both the force and direction of air stream 20, the user may move object 18 under, over, through, or, around the plurality of obstacles 22 selectively positioned along pathway 16.

Figure 2:
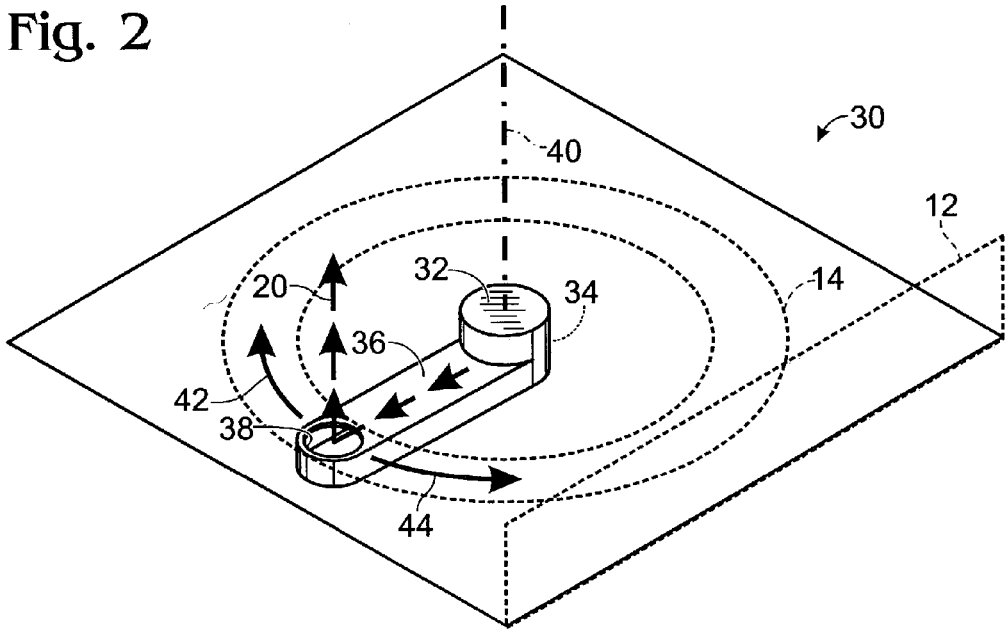
FIG. 2 is an isometric view of a levitation mechanism suitable for use with the toy shown in FIG. 1.

Typically, air stream 20 is produced by a levitation mechanism 30. One example of a suitable levitation mechanism 30 is shown in FIG. 2. Levitation mechanism 30 includes a housing 32 enclosing a fan 34. Extending from housing 32 is an airflow passage 36, which terminates in an orifice 38. Operation of fan 34 creates air stream 20, which may be directed through airflow passage 36 and out orifice 38. Orifice 38 may be oriented such that air stream 20 may be directed upwardly through body 12 and perpendicular to pathway 16.

As further shown in FIG. 2, the direction of air stream 20 may be altered by any suitable means including by adapting housing 32 to rotate, such that airflow passage 36 and orifice 38 are also rotated. As shown, housing 32 may rotate around axis 40 and channel 15 may be oriented such that orifice 38 is located underneath channel 15 throughout the entire rotation. Thus, when the housing rotates in a first direction 42, object 18 will be seen to travel along pathway 16 in that direction, for example, clockwise. Similarly, when the housing rotates in a second direction 44, object 18 will be seen to travel along pathway 16 in the opposite direction, for example, counterclockwise.

The force of air stream 20 may be altered by any suitable means including controlling the speed of fan 34 or the use of an airflow restriction or diversion device. For example, the airflow control device may include a barrier that may be moved to restrict the movement of air produced by fan 34 into airflow passage 36 by incrementally blocking airflow passage 36. An exemplary air flow restriction device is described in greater detail below with respect to the embodiment depicted in FIGS. 3–7.

As stated above, toy 10 may include one or more control elements 28, which enable the user to control the direction and force of air stream 20, thereby allowing the user to move object 18 along pathway 16. These control elements may take the form of buttons, knobs, levers, or other suitable user-implemented control elements.

The control element may be in electronic or mechanical communication with levitation mechanism 30 in order to allow the user to control air stream 20. For example, toy 10 may include a motor (not shown) in communication with control element(s) 28 and adapted to rotate housing 32. Alternatively, the control element may be mechanically engaged with the levitation mechanism, such as by including one or a series of interconnected toothed gears (not shown), which are, in turn, mechanically engaged with housing 32.

In addition, the same or a different control element may be in electronic or mechanical communication with the airflow control device in order to allow the user to control the force of airflow 20. Again, the control device may be moved through the use of a motor, a series of gears, or any other suitable means.

In one embodiment, the toy may be based on a well-known popular culture phenomenon, such as a book or movie. For example, the embodiment of the present invention shown as toy 46 in FIGS. 3–7 is based characters and events from the popular children's book *Harry Potter and the Sorcerer's Stone,* by J. K. Rowlings.

Figure 3:
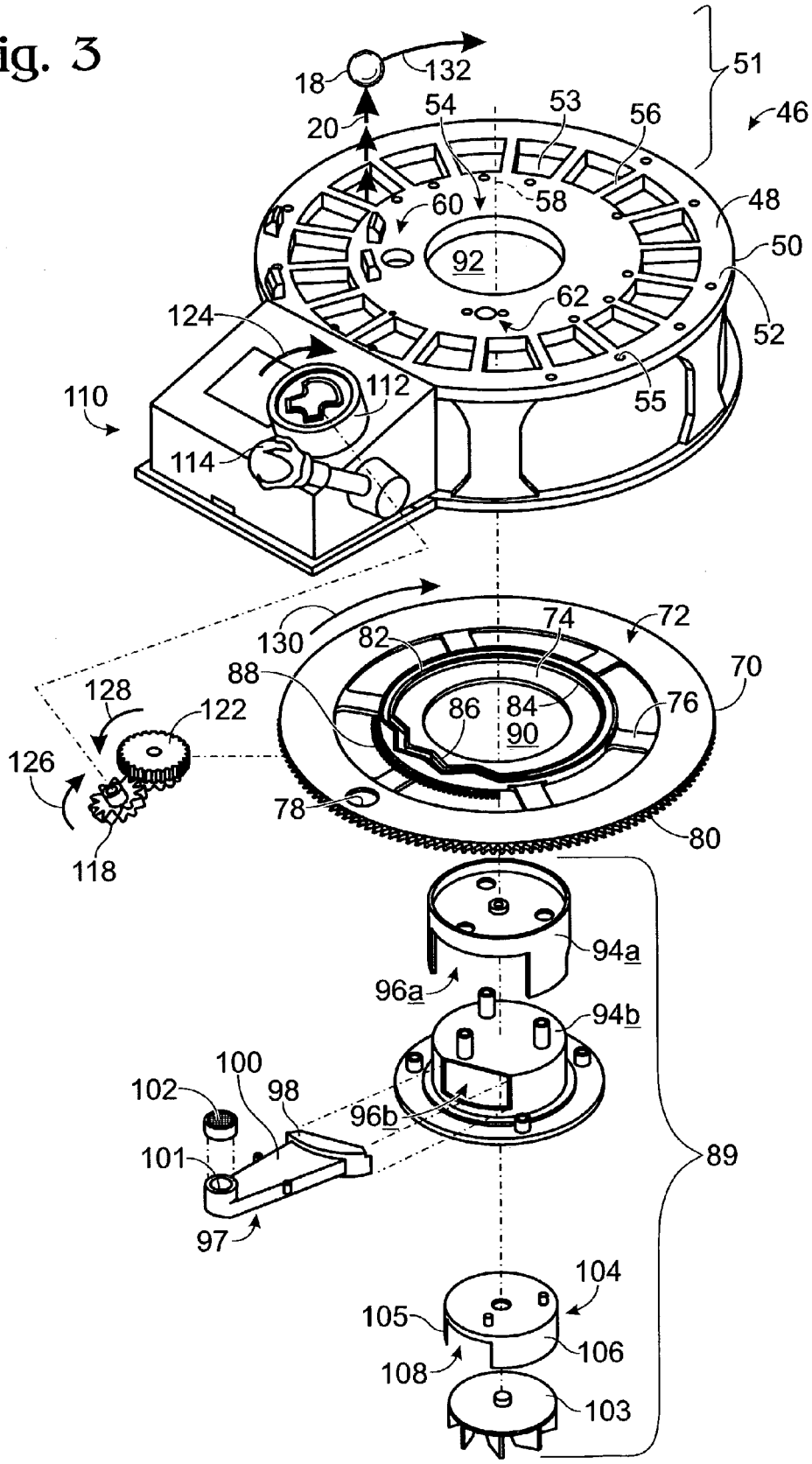
FIG. 3 is an exploded view of an exemplary embodiment of a toy according to the present invention.

FIGS. 3–7 present exploded views of toy 46, which is a more detailed illustration of an exemplary embodiment of the present invention. As shown in FIG. 3, a body 48 includes a generally circular portion 50. The upper surface of circular portion 50 defines a playing field 51. Circular portion 50 includes an outer region 52 and an inner region 54, which define a channel 53. Outer region 52 and inner region 54 are connected by a plurality of bridges 56 that span channel 53. Outer region 52 and inner region 54 further include a plurality of small holes 55, which form a plurality of mounting stations for selectively placing the various obstacles along pathway 57. Inner region 54 further includes one or more engagement regions 60 and 62 for placing additional obstacles (such as those shown and described with respect to FIGS. 4–6) along pathway 57.

Housed within circular portion 50 is an annular-disk 70 including an outer region 72 and an inner region 74. Outer region 72 and inner region 74 are connected by a plurality of bridges 76. Outer region 72 includes an orifice 78. Teeth 80 on the outer perimeter of outer region 72 enable annular disk 70 to act as a gear when contacted by a similarly toothed rotating gear, as described in further detail below. Inner region 74 includes a track 82 including an uniformly curved portion 84 and an irregular portion 86. Non-linear portion 86 is generally aligned with the location of orifice 78 in outer region 72. Moreover, a portion of the outer perimeter of inner region 74, generally adjacent non-linear portion 86, includes teeth 88.

A levitation mechanism 89 may be seated within a circular central opening 90 of annular disk 70 and a corresponding central opening 92 of circular portion 50. In the embodiment shown in FIGS. 3–7, levitation mechanism 89 includes generally cylindrical outer casings 94*a* and 94*b*, which include gaps 96*a* and 96*b*, respectively. Airflow passage 36 includes a mouth portion 98, which is adapted to engage gap 96*b*, and an elongated portion 100, which terminates in an upwardly directed orifice 101. As shown, orifice 101 may be covered by a grated cap 102, which prevents objects from falling into it and thus potentially blocking or obstructing airflow passage 97. Moreover, when properly seated within annular disk 70, orifice 101 of airflow passage 97 engages orifice 78 of annular disk 70, such that any rotation of annular disk 70 will result in corresponding rotation of airflow passage 97 about central axis 58.

Housed within outer casings 94*a* and 94*b* is a motor-operated fan 103. Situated between outer casings 94*b* and fan 103 is airflow control device 104, which in this embodiment takes the form of a generally cylindrical casing 105 having a solid side 106 and a gap 108. When gap 108 in airflow control device 104 is aligned with gaps 96*a* and 96*b*, airflow control device 104 can be said to be in the "open" position and the full force of air stream 20 created by fan 103 is able to flow into airflow passage 97. In this position, object 18 is elevated by air stream 20 to its highest trajectory relative to orifice 101. However, airflow control device 104 is adapted to be rotated independently of outer casings 94*a* and 94*b* and fan 103 so that solid side 106 may block some or all of gap 96, thus restricting the amount of air stream 20 that flows into airflow passage 97. As will be appreciated, when a portion of air stream 20 is prevented from entering airflow passage 97, air stream 20 has less force, and object 18 travels at a lower trajectory. The greater the degree of airflow that is restricted, the lower the trajectory of object 18 along pathway 57. Thus, airflow control device 104 is typically configured such that solid side 106 can be incrementally moved to block airflow passage 97 in order to allow the user to incrementally control the height of object 18.

In the embodiment shown in FIGS. 3–7, in addition to circular portion 50, body 48 further includes control box 10. Control box 110 typically houses various mechanisms that allow the user to control the height and direction of travel of object 18. As shown more particularly in FIG. 3, control box 110 may include two or more control elements, such as knob 112 and lever 114.

Knob 112 may allow the user to control the movement and direction of travel of object 18 by controlling rotation of levitation mechanism 89. Rotation of levitation mechanism 89 and thus the direction of travel of object 16, may be achieved by rotation of a series of toothed gears linked to a control element such as knob 112, which in the depicted embodiment is located on the upper external surface of control box 110. As shown, knob 112 engages gear 118, which is housed within control box 110. Gear 118 engages gear 122, which in turn engages the toothed portion 80 of annular disk 70.

When knob 112 is rotated in a first direction, such as clockwise, as shown by arrow 124, gear 118 is rotated clockwise, as shown by arrow 126. Clockwise rotation of gear 118 results in counterclockwise rotation of gear 122, as shown by arrow 128, which in turn rotates annular disk 70 in the clockwise direction, shown by arrow 130. Because the outer casing 94*a* is seated in and moves with annular disk 70, clockwise rotation of annular disk 70 results in clockwise rotation of airflow passage 97, thereby moving air stream 20 along pathway 57 in a clockwise direction (shown by arrow 132). Similarly, rotation of knob 112 in a second direction, such as counterclockwise, results in movement of air stream 20 along pathway 57 in a counterclockwise direction.

The second control element (i.e. lever 114) may allow the user to control the height of object 18 by controlling the force of air stream 20. As stated above, the force of air stream 20, and thus the height of object 18, may be controlled by incrementally blocking airflow passage 97 with airflow control device 104. In this embodiment, lever 114 controls movement of airflow control device 104. In the depicted embodiment lever 114 is located on the external surface of control box 110. Lever 114 may be electrically or mechanically connected to airflow control device 104 so as to allow the user to effectively raise and lower the trajectory of object 18 as it travels along pathway 57.

Figure 4:
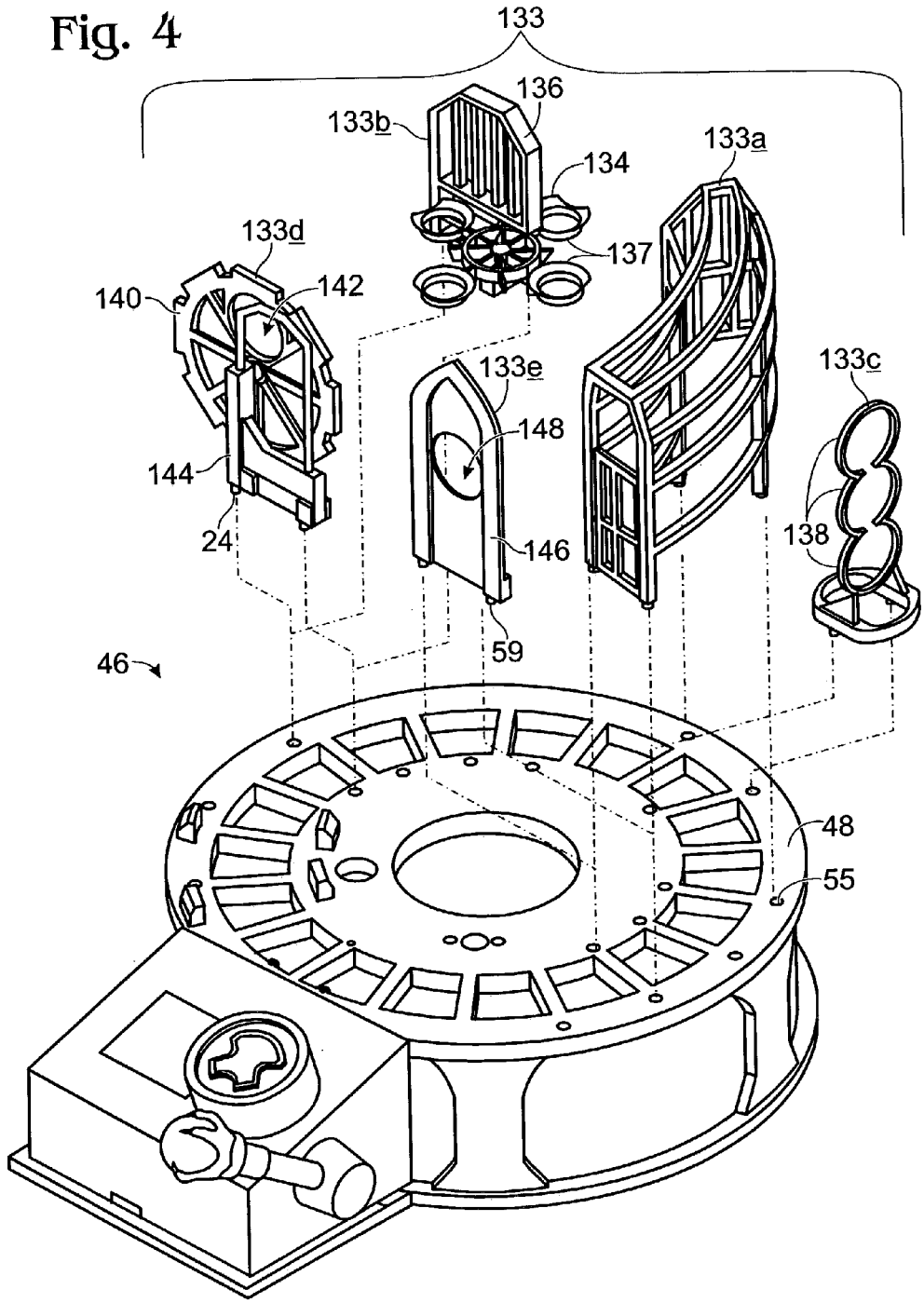
FIG. 4 is an exploded view of the toy of FIG. 3 showing exemplary obstacles.

Turning to FIG. 4, typically, toy 46 is adapted to allow the players to create a wide variety of obstacle courses by providing a number of obstacles that may be removably placed along pathway 57. As previously described, body 48 includes a number of holes 55 into which pins 24 on the bottom of obstacles 133 may be placed. Because the spacing of the holes 55 and pins 59 is consistent throughout both body 12 and the various obstacles 22, most of obstacles 22 are interchangeable in terms of placement along pathway 57.

As shown, obstacle 133a resembles a curved elongated maze through which object 18 may be manipulated. As shown, the curvature of obstacle 133*a* follows the curvature of pathway 57 such that obstacle 133*a* may be placed along the pathway. As described above, obstacle 133*a* may be removably secured to body 48 by placing pins 59 in holes 55.

Obstacle 133*b* includes a horizontal wheel 134 rotatably seated inside a gate 136. Horizontal wheel 134 includes a plurality of stations 137, adapted to receive object 18. Horizontal wheel 134 rotates when engaged by air stream 20. Players may try to drop levitating object 18 in station 137 by reducing the force of air stream 20 in such a manner that the rotation of horizontal wheel 134 will carry object 18 around gate 136. Once object 18 has been carried around gate 136, the player may then levitate object 18 out of the station 137, by increasing the force of air stream 20, and moving air stream 20 along the rest of pathway 57.

Obstacle 133*c* includes a series of three hoops 138. A player may attempt to pass levitating object 18 through any one of the hoops as the player moves object 18 along pathway 57.

Obstacle 133*d* includes a vertical wheel 140, having an opening 142. Opening 142 is sized appropriately to allow object 18 to pass through. Vertical wheel 140 rotatably engages supporting structure 144. A player may attempt to pass levitating object 18 through opening 142 as the player moves object 18 along pathway 57.

Obstacle 133*e* includes a door-shaped body 146 including an orifice 148, through which object 18 may pass.

As will be appreciated, various other obstacles may be included with toy 46, including, but not limited to those described below. Furthermore, by adding or removing obstacles or replacing one obstacle with another, the user can readily alter the design of the obstacle course. Moreover, because the spacing of pins 24 is consistent between all the obstacles, obstacles 22 may be placed interchangeably at different locations on body 48.

Figure 5:
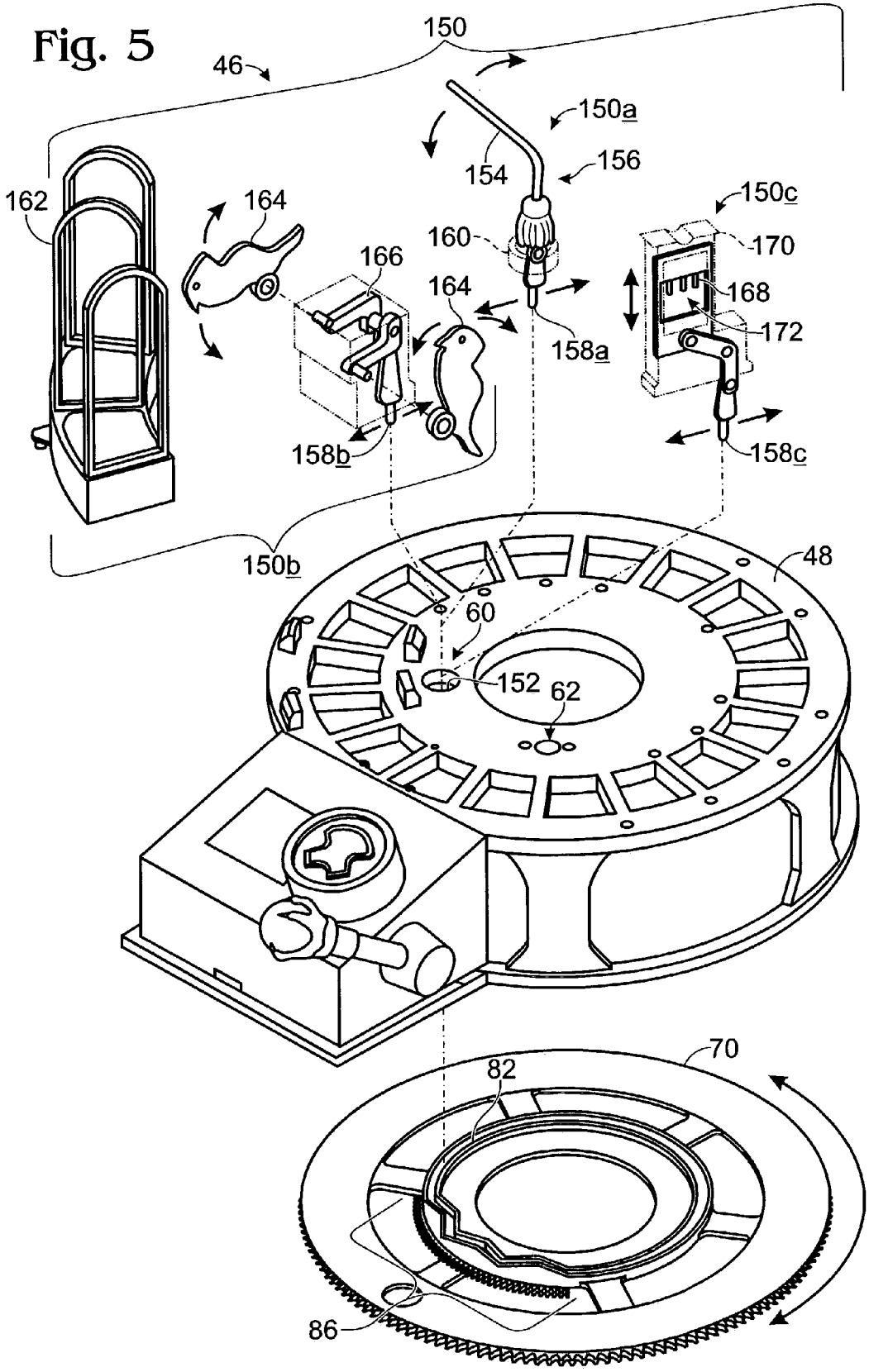
FIG. 5 is an exploded view of the toy of FIG. 3 showing exemplary interactive obstacles.

Turning to FIG. 5, as previously stated, body 12 may include engagement regions 60 and 62, which provide access to internal mechanisms within body 12. These internal mechanisms provide for the use of one or more interactive obstacles 150. Typically, each interactive obstacle 150 is capable of interacting with an internal mechanism housed within body 12. This interaction results in movement by interactive obstacle 150.

The internal mechanism may include, for example, first engagement region 60, which includes an orifice 152 in body 12. Orifice 152 provides access to a circular grooved track 82 in annular disk 70. As previously stated, grooved track 82 is adapted to vary in amplitude along at least a portion of the track, shown by irregular region 86. As shown, each interactive obstacle includes an elongated element 158. Each elongated element 158 is adapted to travel inside grooved track 82. As elongated element 158 travels along non-linear region 86 of track 82, the elongated element is forced to move laterally of the channel. This movement is translated to at least a portion of the interactive obstacle, which must be negotiated by the player in order to complete the obstacle course.

An examplary interactive obstacle 150 is interactive obstacle 150*a*, which is shaped like a broom. When placed in contact with the internal mechanism described above, broom handle 154 moves along pathway 57, creating a moving obstacle that must be avoided by the player. Interactive obstacle 150*a* includes a broom-shaped portion 156, which terminates in an elongated element 158*a*. As described above, elongated element 158*a* is adapted to travel inside grooved track 82. Broom-shaped portion 156 is pivotally attached to a housing 160. Housing 160 is adapted to be received by orifice 152. Thus, when housing 160 is placed in orifice 152, elongated element 158 fits inside grooved track 82. As annular disk 70 is rotated, elongated element 158 travels along grooved track 82. When the portion of grooved track 82 in which elongated element 158 is traveling varies in amplitude, i.e. when elongated element 158*a* travels along irregular portion 86, broom-shaped portion 156 pivots with respect to housing 160, thus making broom-shaped portion 156 move relative to housing 160 and thus, body 12. Broom handle 154 traverses pathway 57, creating a moving obstacle that must be avoided by players as they move object 18 along pathway 57.

Another exemplary interactive obstacle is obstacle 150*b*. Obstacle 150*b* includes a cage 162 in which are placed a plurality of bird shaped figures 164, which are pivotally connected to support 166. Support 166 includes an elongated element 158*b*, which travels track 82 in the manner described above with respect to interactive obstacle 150*a*. As elongated element 158*b* travels in irregular region 86 of track 82, support 166 moves, causing figures 164 to pivot. Cage 162 may be placed along pathway 57 such that a player must negotiate cage 162 and pivoting figures 164 as the player moves object 14 along pathway 57.

A further example of an interactive obstacle suitable for use with the present invention is guillotine-shaped interactive obstacle 150*c*. In this example, movement of elongated element 158*c* results in the downward motion of a guillotine blade 168, which moves through a space 172 inside a housing 170. Thus, when interactive obstacle 150*c* is placed on pathway 57, players may attempt to pass object 14 through space 172, while avoiding blade 168.

As will be appreciated, various other interactive obstacles may be included with toy 10, each of which relying on the use of an elongated element adapted to fit inside grooved track 82 in order to make part of the obstacle move. Furthermore, by replacing one interactive obstacle with another, the user can readily alter the design of the obstacle course. Moreover, it should be appreciated that while the embodiment shown in FIGS. 3–7 depict only one orifice 136 that provides access to grooved track 82, toy 10 may include a plurality of similar access providing orifices along channel 53. Alternatively or additionally, toy 10 may include one or more additional grooved tracks.

Figure 6:
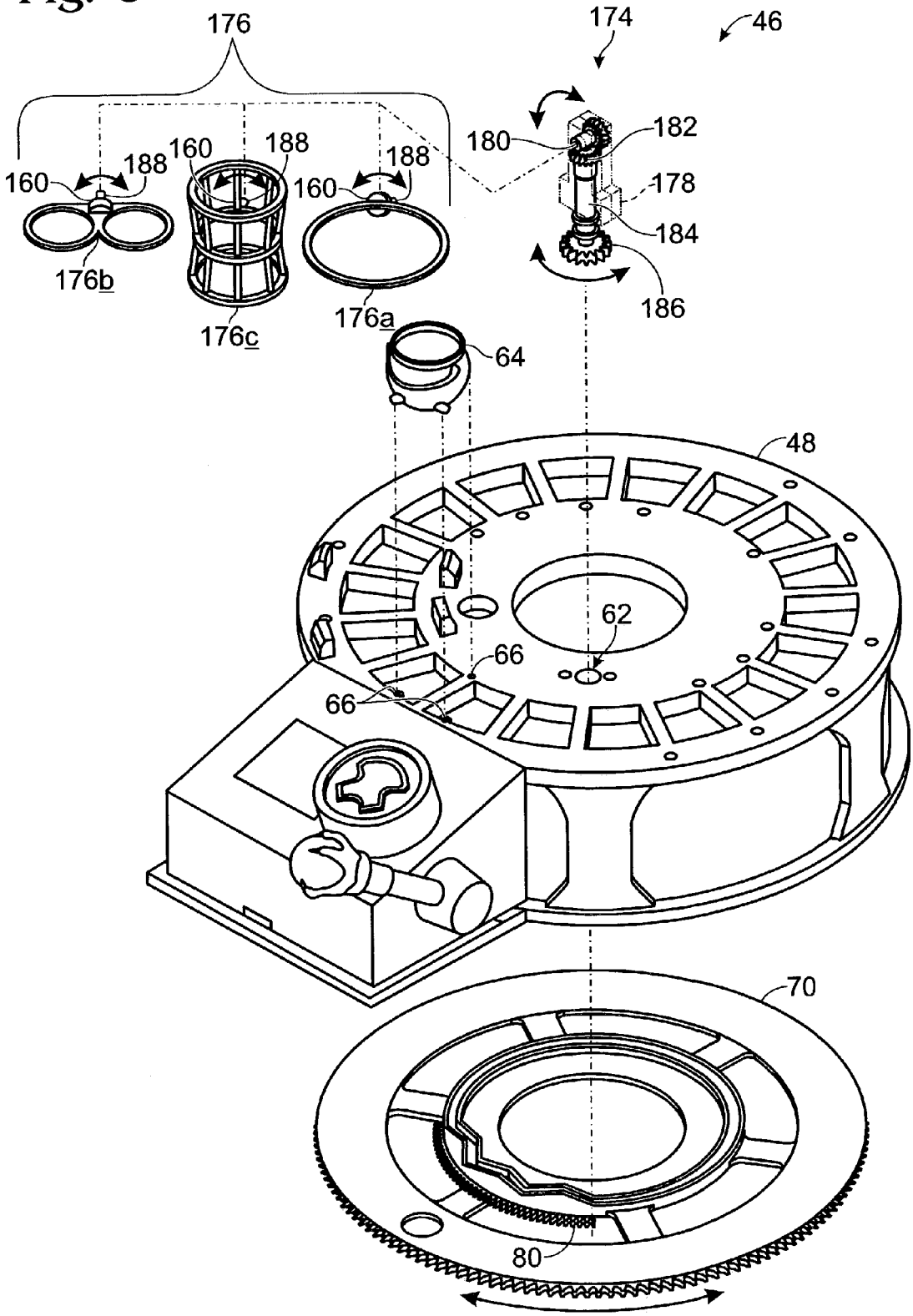
FIG. 6 is an exploded view of the toy of FIG. 3 showing exemplary rotating obstacles.

Turning to FIG. 6, as an alternative or additional feature, toy 10 may include a rotating mechanism, or spinner drive, 174, which may engage disk 70 via region 62. Spinner drive 174 allows players to add a variety of rotating obstacles 176, such as a hoop 176*a*, a double hoop 176*b*, or a barrel 176*c*, to the obstacle course. Spinner drive 174 may utilize a series of gears that are driven during rotation of annular disk 70.

For example, in the embodiment shown in FIG. 6, spinner drive 174 includes a body 178, from which a gear driven receptacle 180 protrudes. Gear driven receptacle 180 is engaged with a gear 182. Gear 182 communicates with a drive shaft 184. Drive shaft 184 communicates with a gear 186, which is adapted to engage teeth 80 on annular disk 70. Thus, when annular disk 70 is rotated, the various components of spinner drive 174 are likewise rotated.

Rotating obstacles 146, including hoop 146*a*, double hoop 146*b*, and barrel 146*c*, each includes a pin 188, which is adapted to be frictionally received by gear-shaped receptacle 180 such that when gear-shaped receptacle 180 is rotated, the rotating obstacle is rotated. As will be appreciated, because spinner drive 174 is adapted to receive any of the rotating obstacles 176 interchangeably, the user can alter the obstacle course along pathway 57 simply by replacing one rotating obstacle with another. Moreover, while the embodiment of toy 10 shown in FIGS. 3–7 includes only one spinner drive 174, it should be appreciated that toy 10 may include a plurality of spinner drives.

Figure 7:
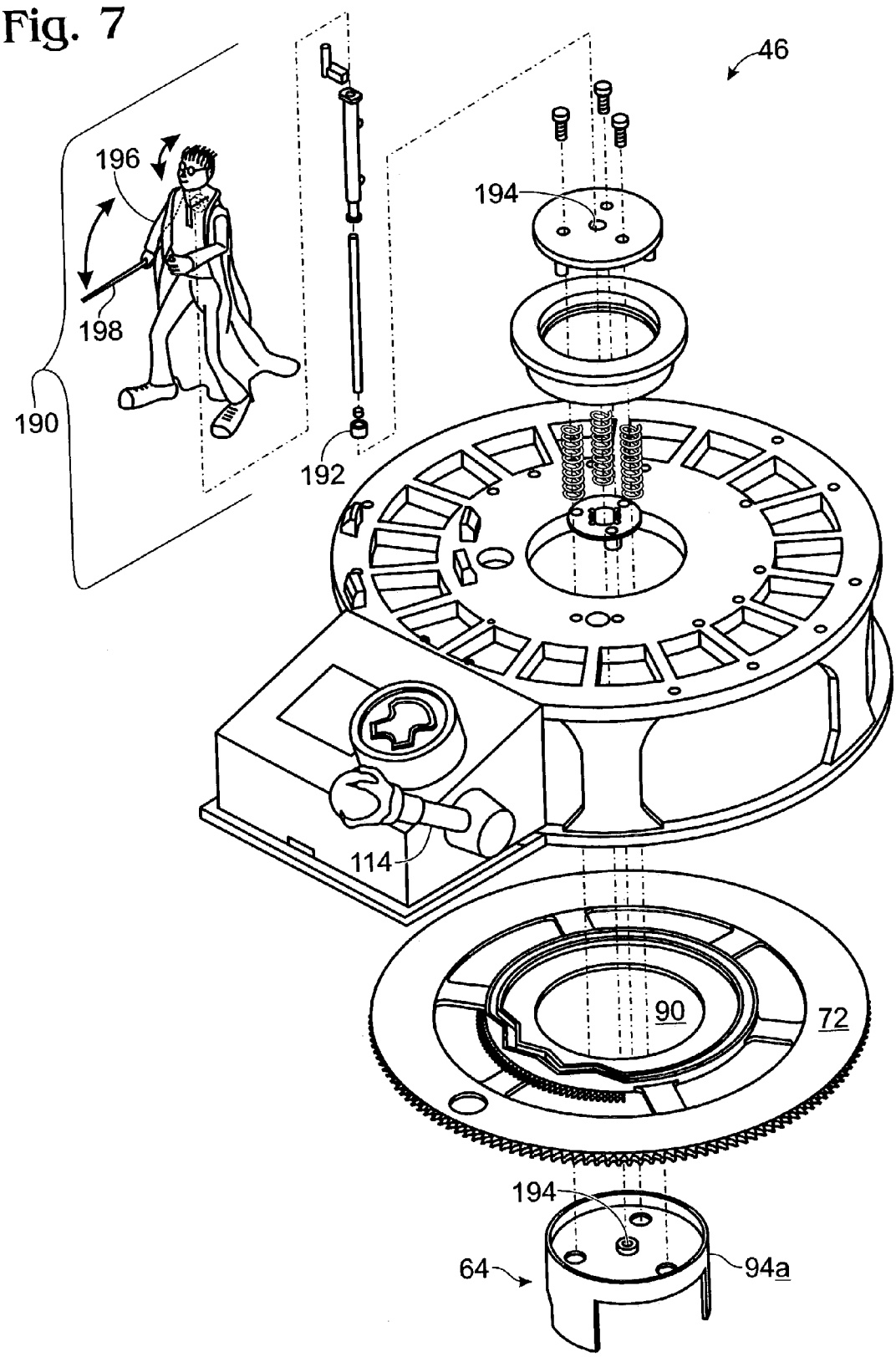
FIG. 7 is an exploded view of toy 3 showing an exemplary central figure.

As shown in FIG. 7, toy 46 may further include a central figure 190, the movements of which are adapted to follow the trajectory of object 18. In the embodiment depicted in FIG. 7, central figure 190 may resemble a person, and more specifically, the character Harry Potter. A pin 192 in figure 190 is adapted to be inserted into an orifice 194 in outer casing 94*a*, such that figure 190 rotates as outer casing 94*a* rotates. In addition, arm 196, which includes wand 198, may be in mechanical or electrical communication with lever 114, such that movement of lever 114 is translated to arm 196. In this manner, arm 196 is adapted to raise and lower in response to lever 114, giving the appearance that Harry Potter is controlling the movement of object 18 with his magic wand.

As stated above, the present invention provides a toy that enables users to design and create their own obstacle course through which a levitating object may be manipulated. By increasing or decreasing the number of obstacles along the obstacle course and/or by adding or removing obstacles that require more skilled manipulation, users can increase or decrease the difficulty level of the obstacle course, as desired.

Furthermore, the present invention may provide apparatus and rules to enable the use of a toy such as those described above as part of a single- or multi-player game. For example, the toy may include a timer, which indicates to the user how much time he or she required to complete the obstacle course. Rules for single player games may specify that the user complete a given course in a predetermined time period or improve his or her best time in order to achieve various rankings.

Multi-player games may involve players competing on the same obstacle course for the fastest time. Alternatively, players may compete to complete more and more difficult obstacle courses. For example, players may take turns navigating increasingly difficult obstacle courses until all but one of the players are eliminated. Alternatively, each player may continue to navigate increasingly difficult obstacle courses until he or she fails on a particular course, at which point it is the next player's turn. Moreover, as with the single player game, a pre-determined time limit, such as three minutes may be imposed. Players who fail to complete the obstacle course within the time limit may receive some type of penalty such as being eliminated from the game or losing their turn.

The timer may be mechanical or electronic. Furthermore, the timer may indicate the user's time through any suitable means including any visual or audible sign or signal. For example, the toy may include a visual display. Alternatively, the toy may include an audio cue that is transmitted by a speaker.

It is believed that the disclosure set forth above encompasses multiple distinct inventions with independent utility. While each of these inventions has been disclosed in its preferred form, the specific embodiments thereof as disclosed and illustrated herein are not to be considered in a limiting sense as numerous variations are possible. The subject matter of the inventions includes all novel and non-obvious combinations and subcombinations of the various elements, features, functions and/or properties disclosed herein. Similarly, where the claims recite "a" or "a first" element or the equivalent thereof, such claims should be understood to include incorporation of one or more such elements, neither requiring nor excluding two or more such elements.

Inventions embodied in various combinations and subcombinations of features, functions, elements and/or properties may be claimed in a related application. Such claims, whether they are directed to a different invention or directed to the same invention, whether different, broader, narrower or equal in scope to any original claims, are also regarded as included within the subject matter of the inventions of the present disclosure.

What is claimed is:

1. A toy comprising:

a playing field including a plurality of mounting stations distributed along a pathway;

a plurality of obstacles adapted to interchangeably engage the mounting stations, wherein one or more of the obstacles include one or more mounting pins and the mounting stations include a plurality of orifices disposed along the upper surface of the body, the orifices being adapted to receive the mounting pins;

a levitation mechanism housed within a body, wherein the body has an upper surface defining the playing field, the levitation mechanism being adapted to:

produce an air stream; and move the air stream along the pathway; and a controller in communication with the levitation mechanism, the controller being adapted to control movement of the air stream along the pathway, wherein the pathway is continuous and circular.

2. A toy comprising:

a playing field including a plurality of mounting stations distributed along a pathway;

a plurality of obstacles adapted to interchangeably engage the mounting stations, wherein one or more of the obstacles include one or more mounting pins and the mounting stations include a plurality of orifices disposed along the upper surface of the body, the orifices being adapted to receive the mounting pins;

a levitation mechanism housed within a body, wherein the body has an upper surface defining the playing field, the levitation mechanism being adapted to produce an air stream flowing in an upward direction and to move the air stream generally transverse to the upward direction along the pathway; and a controller in communication with the levitation mechanism, the controller being adapted to control movement of the air stream along the pathway.

3. The toy of claim 2 wherein the upper surface of the body comprises a channel defining the pathway.

4. The toy of claim 3 wherein a portion of the levitation mechanism is adapted to travel along the channel.

5. The toy of claim 2 wherein the force of the air stream is alterable.

6. The toy of claim 5 wherein the levitation mechanism is adapted to alter the force of the air stream.

7. The toy of claim 6 wherein the controller is adapted to communicate with the levitation mechanism in order to control the force of the air stream.

8. The toy of claim 2 where the body further includes a plurality of engagement regions configured to provide access to the levitation mechanism within the body.

9. The toy of claim 2 where the levitation mechanism includes a first toothed gear, and at least one of the plurality of obstacles includes a second toothed gear, and where the first toothed gear engages the second toothed gear such that when the first toothed gear is rotated, the second toothed gear is rotated and motion is translated to a portion of the moving obstacle.

10. The toy of claim 9 where the first toothed gear is rotated by way of the controller.

11. A toy comprising:

a playing field including a plurality of mounting stations distributed along a pathway;

a plurality of obstacles adapted to interchangeably engage the mounting stations, wherein one or more of the obstacles include one or more mounting pins and the mounting stations include a plurality of orifices disposed along the upper surface of the body, the orifices being adapted to receive the mounting pins;

a levitation mechanism housed within a body, wherein the body has an upper surface defining the playing field, the levitation mechanism being adapted to:

produce an air stream; and move the air stream along the pathway; and a controller in communication with the levitation mechanism, the controller being adapted to control movement of the air stream along the pathway, wherein the upper surface of the body comprises a channel defining the pathway, wherein a portion of the levitation mechanism is adapted to travel along the channel, and wherein the levitation mechanism is further adapted to direct the air stream perpendicular to the channel.

12. A toy comprising:

a playing field including a plurality of mounting stations distributed along a pathway;

a plurality of obstacles adapted to interchangeably engage the mounting stations;

a levitation mechanism adapted to produce an air stream flowing in an upward direction and to move the air stream generally transverse to the upward direction along the pathway; and a controller in communication with the levitation mechanism, the controller being adapted to control movement of the air stream along the pathway.

13. The toy of claim 12, further including a manipulable object adapted to be supported by the air stream.

14. The toy of claim 13 wherein movement of the air stream along the pathway results in movement of the manipulable object along the pathway.

15. The toy of claim 14 wherein when an obstacle is engaged to a mounting station, the obstacle impedes the movement of the manipulable object along the pathway.

16. The toy of claim 12 wherein the pathway is a closed loop.

17. The toy of claim 12, wherein two or more of the obstacles are structurally different from each other.

18. A toy comprising:

a playing field including a plurality of mounting stations distributed along a closed loop;

a plurality of obstacles adapted to interchangeably engage the mounting stations;

a levitation mechanism adapted to produce an air stream flowing in an upward direction and to move the air stream generally transverse to the upward direction along the closed loop; and a controller in communication with the levitation mechanism, the controller being adapted to control movement of the air stream along the closed loop.

* * * * *